US007487823B2

(12) United States Patent
Yamasaki

(10) Patent No.: US 7,487,823 B2
(45) Date of Patent: Feb. 10, 2009

(54) HEATING AND COOLING SYSTEM

(75) Inventor: Haruhisa Yamasaki, Gunma (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 645 days.

(21) Appl. No.: 10/944,411

(22) Filed: Sep. 20, 2004

(65) Prior Publication Data

US 2005/0087334 A1 Apr. 28, 2005

(30) Foreign Application Priority Data

Sep. 30, 2003 (JP) ..... 2003-341460

(51) Int. Cl.
*F25B 29/00* (2006.01)

(52) U.S. Cl. ..... 165/58; 165/48.1; 165/63; 62/498

(58) Field of Classification Search ..... 165/58, 165/61, 64, 918, 919, 63, 48.1; 62/6, 498
See application file for complete search history.

(56) References Cited

U.S. PATENT DOCUMENTS

| | | | | |
|---|---|---|---|---|
| 3,590,911 | A * | 7/1971 | Horvay | 165/64 |
| 4,003,798 | A * | 1/1977 | McCord | 202/160 |
| 4,014,751 | A * | 3/1977 | McCord | 202/160 |
| 4,390,396 | A * | 6/1983 | Koblenzer | 202/166 |
| 4,512,157 | A * | 4/1985 | Weadock | 60/641.8 |
| 4,556,457 | A * | 12/1985 | McCord | 202/206 |
| 4,572,767 | A * | 2/1986 | McCord | 202/170 |
| 5,069,273 | A * | 12/1991 | O'Hearne | 165/61 |
| 5,477,915 | A * | 12/1995 | Park | 165/918 |
| 5,975,202 | A * | 11/1999 | Grandi | 165/48.1 |
| 6,073,547 | A * | 6/2000 | Westbrooks et al. | 165/63 |
| 6,315,039 | B1 * | 11/2001 | Westbrooks et al. | 165/919 |
| 6,367,279 | B1 | 4/2002 | Jin | |
| 6,378,313 | B2 * | 4/2002 | Barrash | 62/6 |
| 6,550,255 | B2 * | 4/2003 | Rudick et al. | 62/6 |
| 7,025,121 | B2 * | 4/2006 | Whitehead et al. | 165/58 |
| 7,040,116 | B2 * | 5/2006 | Yamasaki et al. | 62/498 |

FOREIGN PATENT DOCUMENTS

| | | |
|---|---|---|
| JP | 2000-65444 | 3/2000 |
| JP | 2002-90051 | 3/2002 |
| JP | 2003-121015 | 4/2003 |
| WO | WO 02/42695 A | 5/2002 |

* cited by examiner

*Primary Examiner*—Ljiljana (Lil) V Ciric
(74) *Attorney, Agent, or Firm*—Kratz, Quintos & Hanson, LLP

(57) ABSTRACT

A heating and cooling system is equipped with a fist receiving chamber for receiving a material to be heated and a second receiving chamber for receiving a material to be cooled, having a refrigerant circuit in which a compressor, a gas cooler, a capillary tube, and an evaporator are circularly connected by pipes and in which carbon dioxide is used as a refrigerant. The inside of the first receiving chamber is heated by the gas cooler and the inside of the second receiving chamber is cooled by the evaporator.

1 Claim, 5 Drawing Sheets

HEATING AND COOLING SYSTEM

BACKGROUND OF THE INVENTION

The present invention relates to a heating and cooling system comprising a first receiving chamber for receiving a material to be heated and a second receiving chamber for receiving a material to be cooled.

As shown in FIG. 5, this type of heating and cooling system has heretofore comprised: a storage chamber 201 divided into a cooling chamber 207 and a heating chamber 205 by an insulating wall 203; and a machine chamber 209 disposed under the storage chamber 201. Moreover, the machine chamber 209 stores a compressor 210, a gas cooler 212, a capillary tube 214 which is pressure reducing means, and the like, and constitutes a refrigerant circuit 220 together with an evaporator 216. An electric heater 245 is disposed in the heating chamber 205, and air heated by the electric heater 245 is fed into the heating chamber 205 by a fan 250 to thereby heat the heating chamber 205 and a material to be heated, received in the heating chamber 205.

Here, an operation of a conventional heating and cooling system 400 will be described with reference to FIG. 5. When an operation of the fan 250 is started by a control device (not shown), and power is supplied to the electric heater 245, the air heated by the electric heater 245 is circulated in the heating chamber 205 by the fan 250. Accordingly, the heating chamber 205 and the material to be heated, received in the heating chamber 205 are heated.

Moreover, the control device starts the operation of fans 218 and 219, and also starts a driving element (not shown) of the compressor 210. Accordingly, a low pressure refrigerant gas is drawn into a cylinder of a compression element (not shown) of the compressor 210 and compressed to constitute a high temperature/pressure refrigerant gas, and is discharged into the gas cooler 212.

Furthermore, after the refrigerant gas releases heat by the gas cooler 212, the gas enters the capillary tube 214 via an internal heat exchanger 230 and a strainer 232, pressure of the gas is lowered in the tube, and the gas flows into the evaporator 216. Then, refrigerant evaporates, and absorbs heat from ambient air to thereby fulfill a cooling function. It is to be noted that the air cooled by the evaporation of the refrigerant in the evaporator 216 is circulated in the cooling chamber 207 by the operation of the fan 219 to cool the cooling chamber 207 and the material to be cooled, received in the cooling chamber 207 (see, for example, Japanese Patent Application Laid-Open No. 6-18156).

As described above, it has heretofore been supposed that in the conventional heating and cooling system, the heating chamber is heated by the electric heater, and the control chamber is cooled by the evaporator of the refrigerant circuit. However, when the heating chamber is heated by the electric heater only, power consumption increases, and this raises a problem.

Moreover, in the conventional heating and cooling system, the air which has exchanged the heat with the gas cooler of the refrigerant circuit has been discharged to the outside of the heating and cooling system.

SUMMARY OF THE INVENTION

According to the present invention, there is provided a heating and cooling system which is equipped with a first receiving chamber for receiving a material to be heated and a second receiving chamber for receiving a material to be cooled, the system comprising: a refrigerant circuit in which a compressor, a gas cooler, pressure reducing means, an evaporator and the like are circularly connected in order by pipes and in which carbon dioxide is used as a refrigerant, wherein the inside of the first receiving chamber is heated by the gas cooler, and the inside of the second receiving chamber is cooled by the evaporator.

According to the present invention, since carbon dioxide having satisfactory heating characteristics is used as the refrigerant, the inside of the first receiving chamber is heated by the gas cooler, and the inside of the second receiving chamber is cooled by the evaporator, the inside of the first receiving chamber can be sufficiently heated.

Accordingly, even in a case where a heating member such as an electric heater is used in the first receiving chamber, a capacity of the heating member can be reduced, and therefore power consumption can be reduced.

Moreover, according to the present invention, there is provided a heating and cooling system which is equipped with a first receiving chamber for receiving a material to be heated and a second receiving chamber for receiving a material to be cooled, the system comprising: a refrigerant circuit in which a compressor, a gas cooler, pressure reducing means, an evaporator and the like are circularly connected in order by pipes and in which carbon dioxide is used as a refrigerant; a duct disposed in such a manner as to exchange heat with the inside of the first receiving chamber; first blowing means for blowing air which has exchanged the heat with the gas cooler into the duct; and second blowing means for blowing air which has exchanged the heat with the evaporator into the second receiving chamber.

According to the present invention, since carbon dioxide having satisfactory heating characteristics is used as the refrigerant, the inside of the first receiving chamber is heated by the gas cooler, and the inside of the second receiving chamber is cooled by the evaporator, the inside of the first receiving chamber can be sufficiently heated.

Accordingly, even in a case where a heating member such as an electric heater is used in the first receiving chamber, a capacity of the heating member can be reduced, and therefore power consumption can be reduced.

Moreover, the air which has exchanged the heat with the gas cooler is blown into the duct to heat the duct, and the first receiving chamber is heated by radiant heat of the duct. Accordingly, even when the pipes of the refrigerant circuit on a high pressure side break, a disadvantage that the first receiving chamber is contaminated can-be avoided. Accordingly, reliability of the heating and cooling system can be improved.

DETAILED DESCRIPTION OF THE PREFERRED EMBODIMENT

An object of the present invention is to provide a heating and cooling system capable of reducing power consumption in order to solve the conventional technique. Embodiments of the present invention will be described hereinafter in detail with reference to the drawings.

First Embodiment

Figure 1:
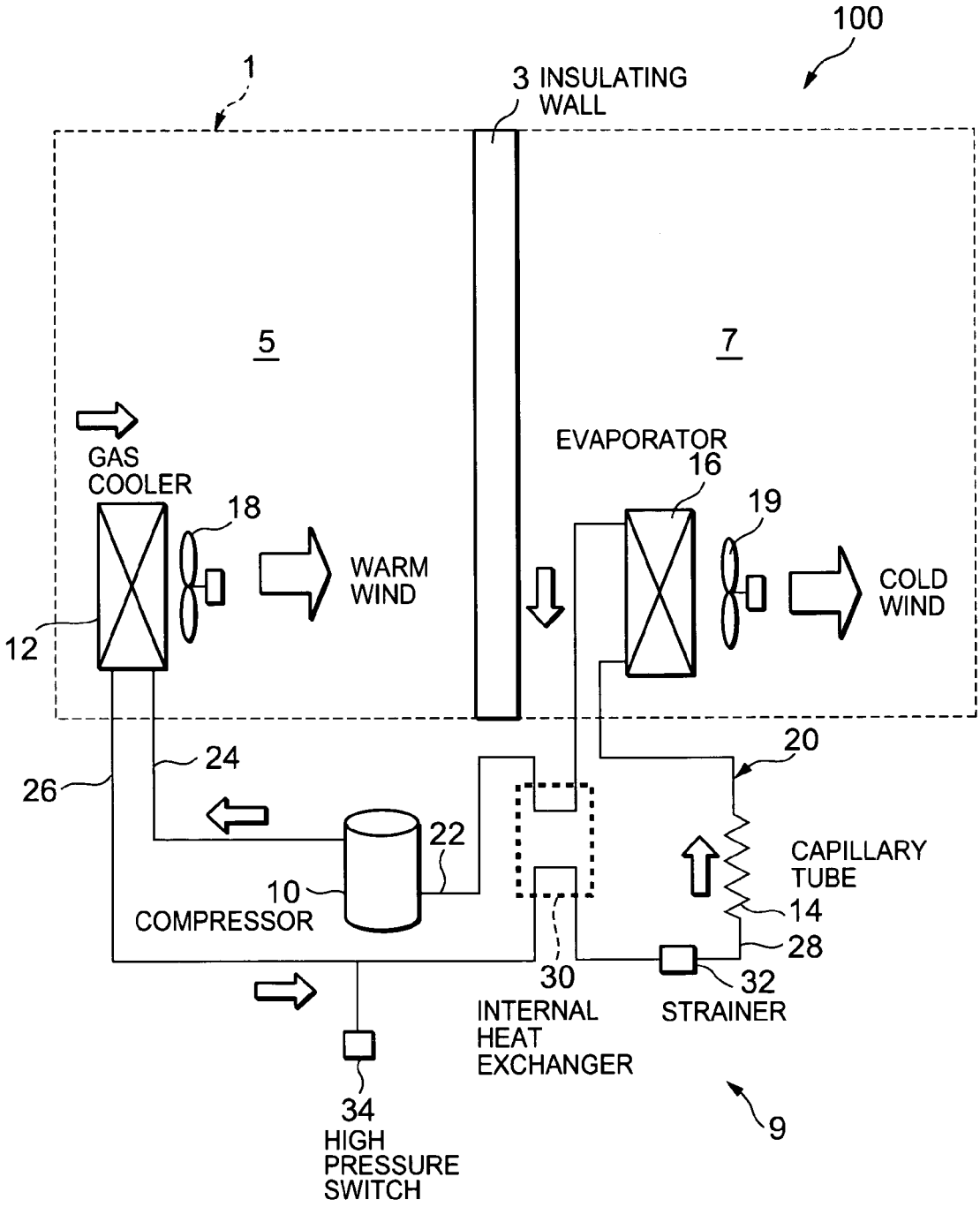
FIG. 1 is an internal constitution diagram of a heating and cooling system according to one embodiment of the present invention.

FIG. 1 is an internal constitution diagram of a heating and cooling system 100 according to one embodiment to which the present invention is applied. It is to be noted that the heating and cooling system of the present invention is usable in a showcase, an automatic dispenser, an air conditioner, or a refrigerator.

In FIG. 1, reference numeral 1 denotes a storage chamber of the heating and cooling system 100, and the storage chamber 1 is surrounded with an insulating member. The storage chamber 1 is divided by an insulating wall 3, a first receiving chamber 5 for receiving a material to be heated is formed on one hand (in a space on the left side of the insulating wall 3 in FIG. 1), and a second receiving chamber 7 for receiving a material to be cooled is formed on the other hand (in a space on the right side of the insulating wall 3 in the figure). A machine chamber 9 is disposed under the storage chamber 1, in which a compressor 10 constituting a part of a refrigerant circuit 20 described later, a capillary tube 14 constituting pressure reducing means and the like are stored.

In the first receiving chamber 5, a gas cooler 12, described later, of the refrigerant circuit 20, and a fan 18 which is first blowing means for blowing (circulating) air which has exchanged heat with the gas cooler 12 into the first receiving chamber 5 are disposed.

Moreover, in the second receiving chamber 7, an evaporator 16 of the refrigerant circuit 20, and a fan 19 which is second blowing means for blowing (circulating) air which has exchanged heat with the evaporator 16 into the second receiving chamber 7 are disposed.

On the other hand, in FIG. 1, reference numeral 20 denotes the above-described refrigerant circuit, and the refrigerant circuit 20 is constituted in such a manner that the compressor 10, the gas cooler 12, a capillary tube 14 that is pressure reducing means, the evaporator 16 and the like are circularly connected in order by pipes.

That is, a refrigerant discharge tube 24 of the compressor 10 is connected to an inlet of the gas cooler 12 installed in the first receiving chamber 5. Here, the compressor 10 of the embodiment is a compressor using carbon dioxide ($CO_2$) as a refrigerant, and the compressor 10 comprises a driving element disposed in a sealed container (not shown) and a compression element driven by the driving element.

In the figure, reference numeral 22 denotes a refrigerant introducing tube for introducing the refrigerant into a cylinder of the compression element (not shown) of the compressor 10, and one end of the refrigerant introducing tube 22 communicates with the cylinder of the compression element (not shown). The refrigerant introducing tube 22 passes through an internal heat exchanger 30 described later, and the other end of the tube is connected to an outlet of the evaporator 16 disposed in the second receiving chamber 7.

Moreover, the refrigerant discharge tube 24 is a refrigerant pipe for discharging the refrigerant compressed by a second rotary compression element into the gas cooler 12.

A refrigerant pipe 26 extending out of the gas cooler 12 passes through the internal heat exchanger 30. It is to be noted that the internal heat exchanger 30 allows a refrigerant from the compressor 10 on a high pressure side, discharged from the gas cooler 12 of the first receiving chamber 5, to exchange the heat with a refrigerant on a low pressure side, discharged from the evaporator 16 of the second receiving chamber 7.

Moreover, the refrigerant pipe 26 on the high pressure side, which has passed through the internal heat exchanger 30, is connected to one end of a strainer 32. This strainer 32 secures and filters foreign matters such as dust and cut wastes mixed in a refrigerant gas circulating in the refrigerant circuit 20, and comprises a filter (not shown) having an opening formed in one end of the strainer 32, and having a substantially conical shape tapered toward the other end of the strainer 32 from the opening. The opening of the filter is attached to the refrigerant pipe 26 connected to one end of the strainer 32 in an adhering state.

A refrigerant pipe 28 connected to the other end of the strainer 32 is connected to an inlet of the evaporator 16 of the second receiving chamber 7 via the capillary tube 14.

The refrigerant pipe 26 is provided with a high pressure switch 34 for detecting a pressure of the refrigerant gas on the high pressure side of the refrigerant circuit 20, and the switch is connected to a control device (not shown). The control device controls the heating and cooling system 100, and controls operations of the compressor 10 or the fans 18 and 19 based on outputs from the high pressure switch 34 and the like.

Next, an operation of the heating and cooling system 100 constituted as described above will be described. The control device (not shown) starts operations of the fan 18 disposed in the first receiving chamber 5 and the fan 19 disposed in the second receiving chamber 7, and also starts the driving element of the compressor 10. Accordingly, a low pressure refrigerant gas is drawn in the cylinder of the compression element (not shown) of the compressor 10 from the refrigerant introducing tube 22, compressed to constitute a high temperature/pressure refrigerant gas, and discharged to the outside of the compressor 10 from the refrigerant discharge tube 24. In this case, the refrigerant is compressed to an appropriate supercritical pressure, and the refrigerant gas discharged from the refrigerant discharge tube 24 flows into the gas cooler 12 disposed in the first receiving chamber 5.

Here, the high temperature/pressure refrigerant compressed by the compressor 10 does not condense, and is operated in a supercritical state. Moreover, the high temperature/pressure refrigerant gas emits the heat in the gas cooler 12. It is to be noted that by the operation of the fan 18, air is heated by the heat emitted from the high temperature/pressure refrigerant in the gas cooler 12, and the air at the high temperature is circulated in the first receiving chamber 5 to heat the first receiving chamber 5 and the material to be heated, received in the first receiving chamber 5.

Moreover, since carbon dioxide is used as the refrigerant in the present invention, the refrigerant does not condense in the gas cooler 12 as described above, therefore a heat exchange capability in the gas cooler 12 is remarkably high, and the air in the first receiving chamber 5 can be heated sufficiently at the high temperature. Accordingly, the first receiving chamber 5 and the material to be heated, received in the first receiving chamber 5 can be heated at the high temperature without using any electric heater as in a conventional technique.

On the other hand, the refrigerant discharged from the gas cooler 12 next passes through the internal heat exchanger 30. Then, the heat of the refrigerant is taken by a refrigerant on the low pressure side, which has been discharged from the evaporator 16, and the refrigerant is further cooled. Since the heat of the refrigerant discharged from the gas cooler 12 and passed through the internal heat exchanger 30 is taken by the refrigerant on the low pressure side by the presence of the internal heat exchanger 30, a supercooling degree of the refrigerant increases the more. Therefore, a cooling capability in the evaporator 16 is enhanced.

The refrigerant gas on the high pressure side cooled by the internal heat exchanger 30 reaches the capillary tube 14 via the strainer 32. It is to be noted that the refrigerant gas still has a supercritical state in the inlet of the capillary tube 14. The refrigerant is formed into a two-phase mixed refrigerant of a gas/liquid by a pressure drop in the capillary tube 14, and flows into the evaporator 16 disposed in the second receiving chamber 7 in this state. Then, the refrigerant evaporates, and absorbs the heat from ambient air to thereby fulfill a cooling function. It is to be noted that the air cooled by the evaporation of the refrigerant in the evaporator 16 is circulated in the second receiving chamber 7 by the operation of the fan 19, and cools the second receiving chamber 7 and a material to be cooled, received in the second receiving chamber 7.

Moreover, the refrigerant flows out of the evaporator 16, enters the refrigerant introducing tube 22, and reaches the internal heat exchanger 30. Then, the refrigerant takes the heat from the refrigerant on the high pressure side, and is subjected to a heating function. Here, the refrigerant evaporates at the low temperature, flows out of the evaporator 16, and is sometimes brought into a liquid mixed state, not a complete gas state. However, when the refrigerant passes through the internal heat exchanger 30 to exchange the heat with the high temperature refrigerant on the high pressure side, the refrigerant is heated. At this time, a degree of superheat of the refrigerant is secured, and the refrigerant is completely formed into a gas.

Accordingly, since the refrigerant discharged from the evaporator 16 can be securely gasified, a liquid refrigerant is securely prevented from being drawn back into the compressor 10 without disposing any accumulator on the low pressure side, and a disadvantage that the compressor 10 is damaged by liquid compression can be avoided. Therefore, the reliability of the heating and cooling system 100 can be enhanced.

It is to be noted that the refrigerant heated by the internal heat exchanger 30 repeats a cycle in which the refrigerant is drawn into the compression element of the compressor 10 from the refrigerant introducing tube 22.

The air which has exchanged the heat with the gas cooler 12 of the refrigerant circuit 20 is circulated in the first receiving chamber 5 by the fan 18 in this manner, and accordingly the material to be heated, received in the first receiving chamber 5, can be heated. The air which has exchanged the heat with the evaporator 16 in the refrigerant circuit 20 is circulated in the second receiving chamber 7 by the fan 19, and accordingly the material to be cooled, received in the second receiving chamber 7, can be cooled.

Especially, since carbon dioxide having satisfactory heating characteristics is used as the refrigerant as described above, the first receiving chamber 5 can be heated using the air which has exchanged the heat with the gas cooler 12. The air has heretofore been discharged to the outside. Therefore, the first receiving chamber 5 and the material to be heated, received in the first receiving chamber 5, can be heated without disposing a heating member such as an electric heater or special heating device. Accordingly, the power consumption of the heating and cooling system 100 can be remarkably reduced.

Second Embodiment

Figure 2:
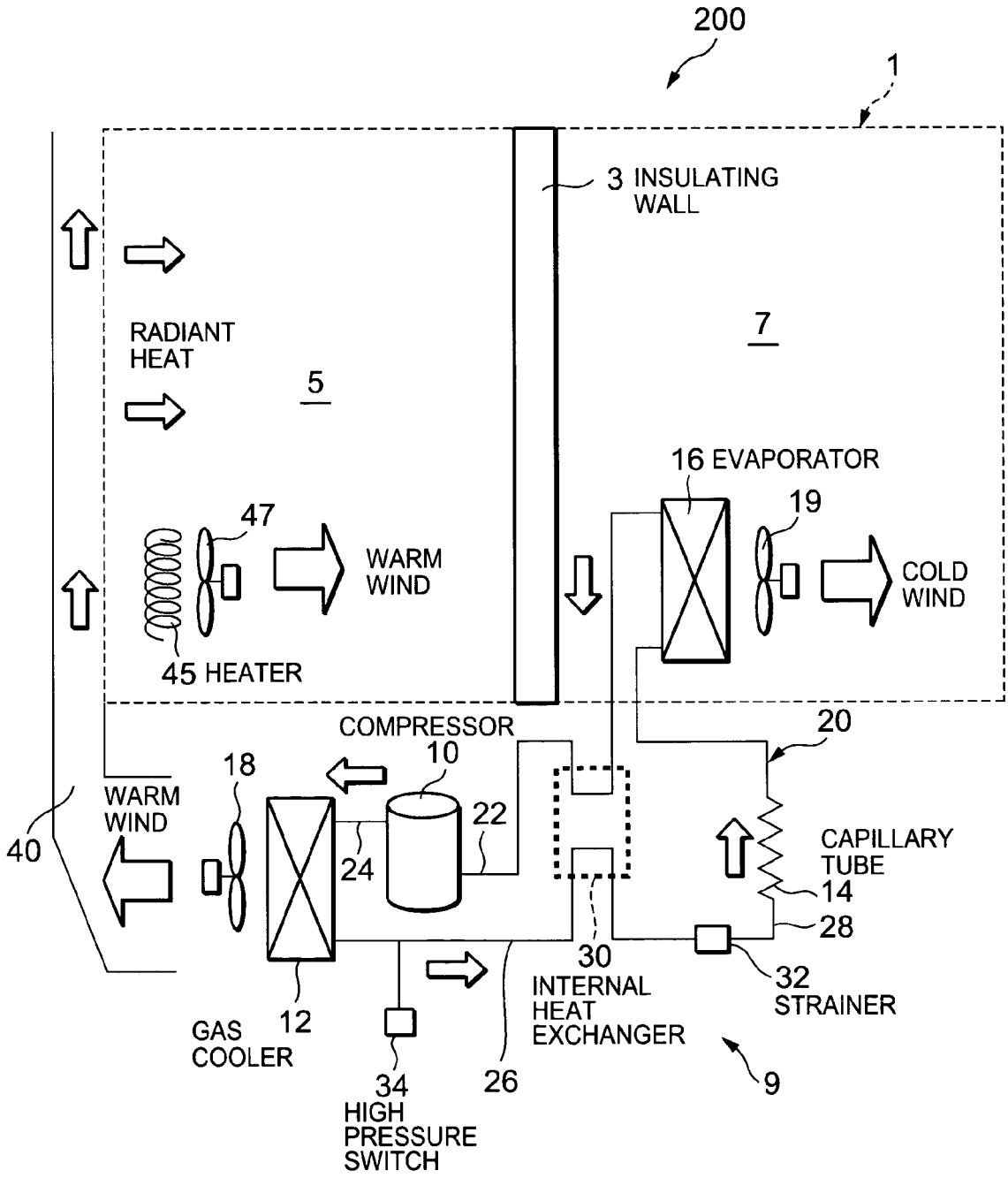
FIG. 2 is an internal constitution diagram of a heating and cooling system according to a second embodiment of the present invention.

Next, another embodiment of a heating and cooling system of the present invention will be described with reference to FIG. 2. FIG. 2 shows an internal constitution diagram of a heating and cooling system 200 in this case. It is to be noted that in FIG. 2, components denoted with the same reference numerals as those of FIG. 1 produce the same or similar effects.

In FIG. 2, reference numeral 40 denotes a duct disposed in such a manner that heat is exchanged with a first receiving chamber 5, and one end of the duct 40 is opened in the gas cooler 12 disposed in the machine chamber 9. The other end of the duct 40 opens above a storage chamber 1, and communicates with the outside of the heating and cooling system 200. Moreover, air which has exchanged the heat with the gas cooler 12 is blown into the duct 40 by the fan 18.

On the other hand, in the first receiving chamber 5, an electric heater 45 for heating the inside of the first receiving chamber 5, and a fan 47 for circulating the air heated by the electric heater 45 in the first receiving chamber 5 are disposed.

Next, an operation of the heating and cooling system 200 in this case will be described. A control device (not shown) starts operations of a fan 18 disposed in a machine chamber 9, a fan 19 disposed in a second receiving chamber 7, and the fan 47 disposed in the first receiving chamber 5, and also starts a driving element of a compressor 10. The control device also starts power supply to the electric heater 45. Moreover, the air heated by the electric heater 45 is circulated in the first receiving chamber 5 by the fan 47, and heats the first receiving chamber 5 and a material to be heated, received in the first receiving chamber 5. By the starting of the driving element, a low pressure refrigerant gas is drawn in a cylinder of the compression element (not shown) of the compressor 10 from a refrigerant introducing tube 22, compressed to constitute a high temperature/pressure refrigerant gas, and discharged to the outside of the compressor 10 from a refrigerant discharge tube 24. In this case, the refrigerant is compressed to an appropriate supercritical pressure, and the refrigerant gas discharged from the refrigerant discharge tube 24 flows into a gas cooler 12 disposed in the machine chamber 9.

Here, the high temperature/pressure refrigerant compressed by the compressor 10 does not condense, and is operated in a supercritical state. Moreover, the high temperature/pressure refrigerant gas emits the heat in the gas cooler 12. It is to be noted that by the operation of the fan 18, air is heated by the heat emitted from the high temperature/pressure refrigerant in the gas cooler 12, and the air at the high temperature is blown into the duct 40. Accordingly, the inside of the duct 40 is heated. Since the duct 40 is disposed in such a manner as to exchange the heat with the first receiving chamber 5, the first receiving chamber 5 is heated by radiant heat of the duct 40. Accordingly, the first receiving chamber 5 and the material to be heated, received in the first receiving chamber 5, can be heated.

Therefore, the first receiving chamber 5 and the material to be heated, received in the first receiving chamber 5, can be heated by both the radiant heat from the duct 40 and the air heated by the electric heater 45 and circulated by the fan 47. When the first receiving chamber 5 is heated by the radiant heat from the duct 40 in this manner, the first receiving chamber 5 can be sufficiently heated without increasing the capacity of the electric heater 45, and therefore the power consumption can be reduced.

Furthermore, in a refrigerant such as carbon dioxide, a refrigerant pressure on a high pressure side becomes very high. Therefore, when this refrigerant is used, there is a possibility that a refrigerant pipe on the high pressure side of the refrigerant circuit 20 breaks by the high pressure. However, in the present embodiment, the gas cooler 12 is disposed in the machine chamber 9, the air which has exchanged the heat with the gas cooler 12 is blown into the duct 40 by the fan 18, and the first receiving chamber 5 is heated by the radiant heat from the duct 40. Therefore, even if the pipes on the high pressure side of the refrigerant circuit 20 are damaged, a disadvantage that the inside of the first receiving chamber 5 is contaminated can be prevented. Accordingly, damages by the breakage of the refrigerant circuit on the high pressure side can be minimized, and reliability of the heating and cooling system 200 comprising the refrigerant circuit 20 using the carbon dioxide refrigerant can be improved.

On the other hand, the refrigerant discharged from the gas cooler 12 next passes through an internal heat exchanger 30. Then, the heat of the refrigerant is taken by a refrigerant on the low pressure side, which has been discharged from the evaporator 16, and the refrigerant is further cooled and reaches the capillary tube 14 via the strainer 32. Moreover, the refrigerant is formed into a two-phase mixed refrigerant of a gas/liquid by a pressure drop in the capillary tube 14, and flows into the evaporator 16 disposed in the second receiving chamber 7 in this state. Then, the refrigerant evaporates, and absorbs the heat from ambient air to thereby fulfill a cooling function. It is to be noted that the air cooled by the evaporation of the refrigerant in the evaporator 16 is circulated in the second receiving chamber 7 by the operation of the fan 19, and cools the second receiving chamber 7 and a material to be cooled, received in the second receiving chamber 7.

Moreover, the refrigerant flows out of the evaporator 16, enters the refrigerant introducing tube 22, and passes through the internal heat exchanger 30 as described above. In this process, the refrigerant takes the heat from the refrigerant on the high pressure side, is subjected to a heating function, and is drawn in the compression element of the compressor 10 from the refrigerant introducing tube 22. This cycle is repeated.

Third Embodiment

Figure 3:
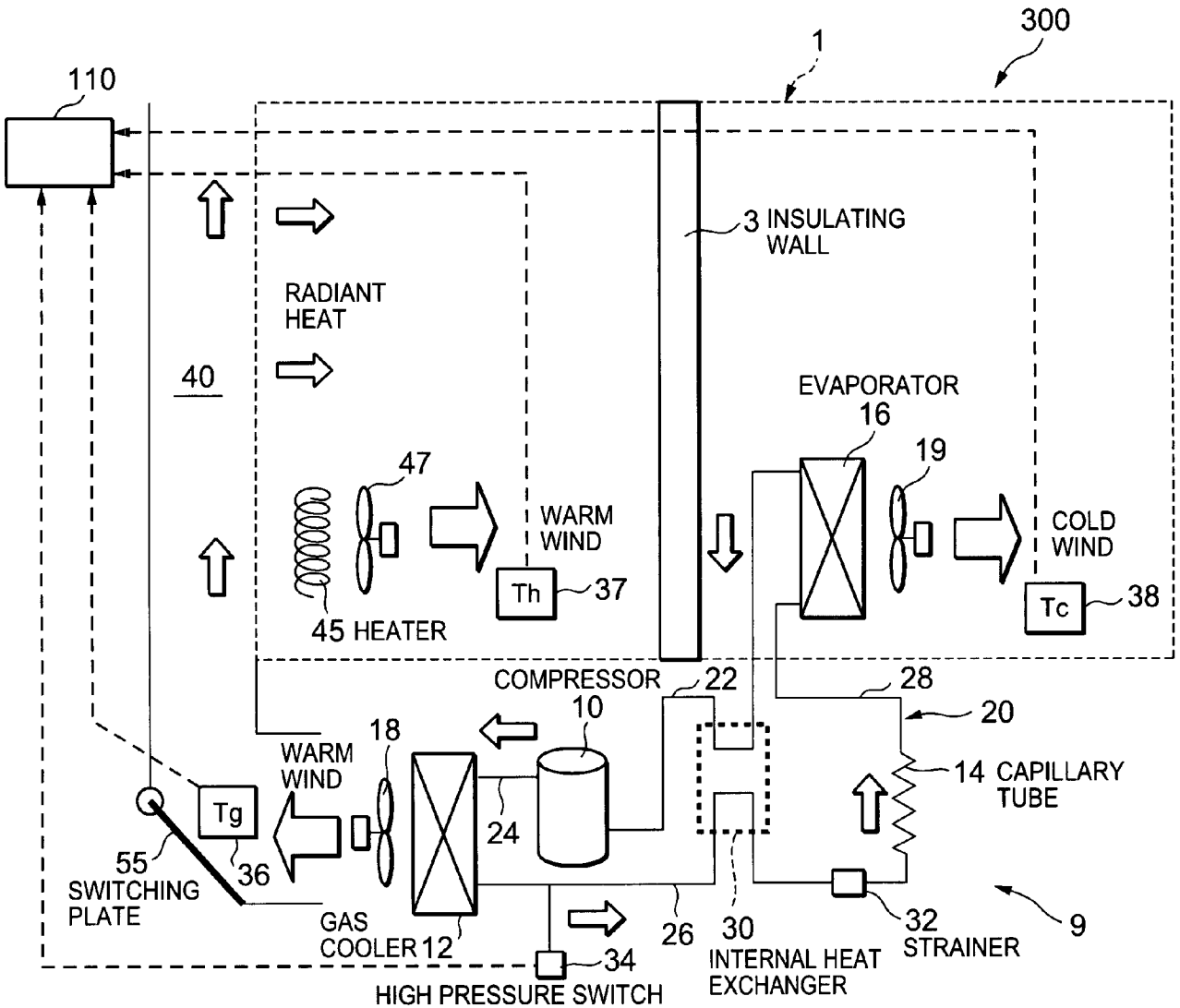
FIG. 3 is an internal constitution diagram of a heating and cooling system according to a third embodiment of the present invention.
Figure 4:
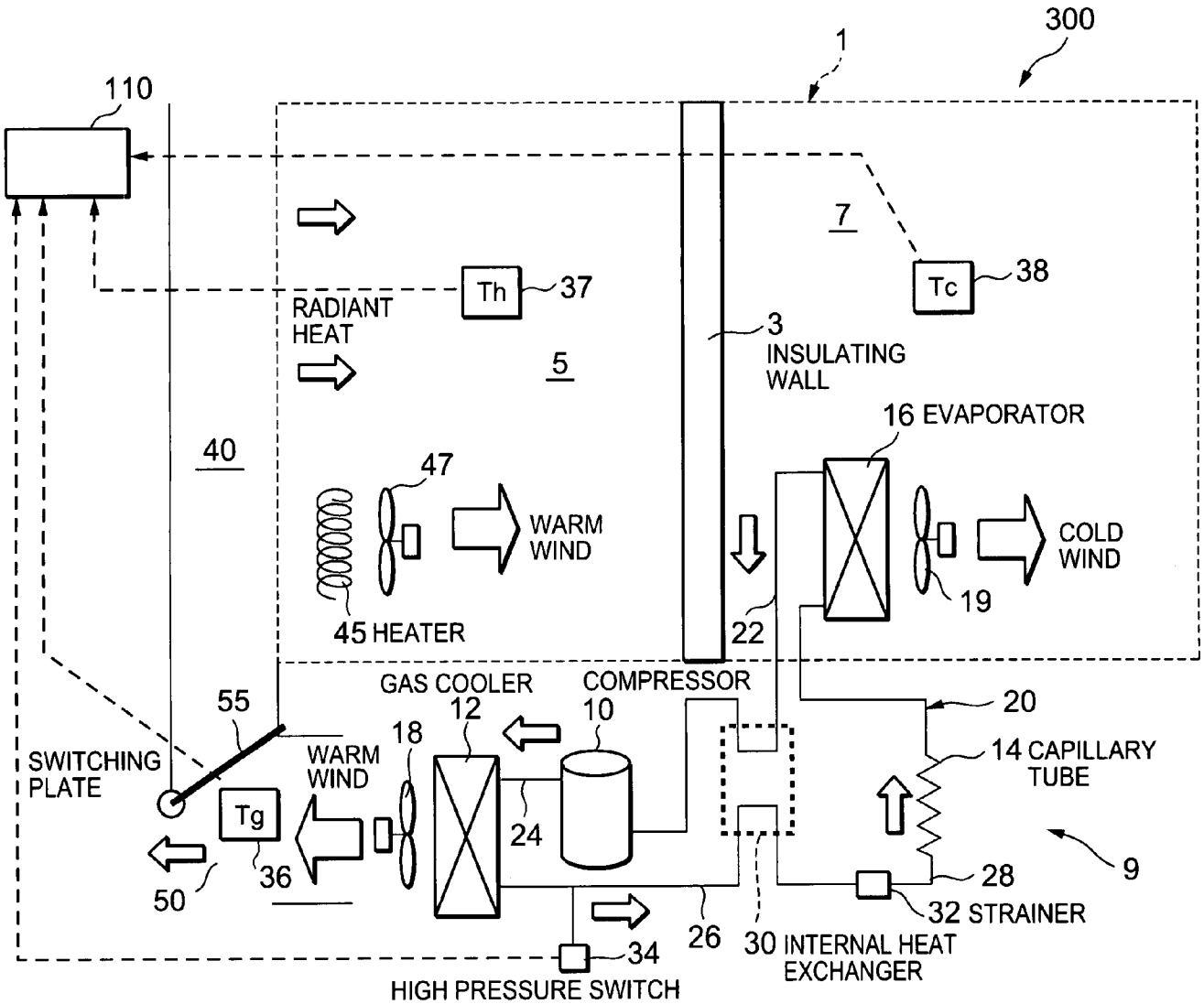
FIG. 4 is an internal constitution diagram showing that a duct of the heating and cooling system of FIG. 3 is closed and a communication hole is opened.
Figure 5:
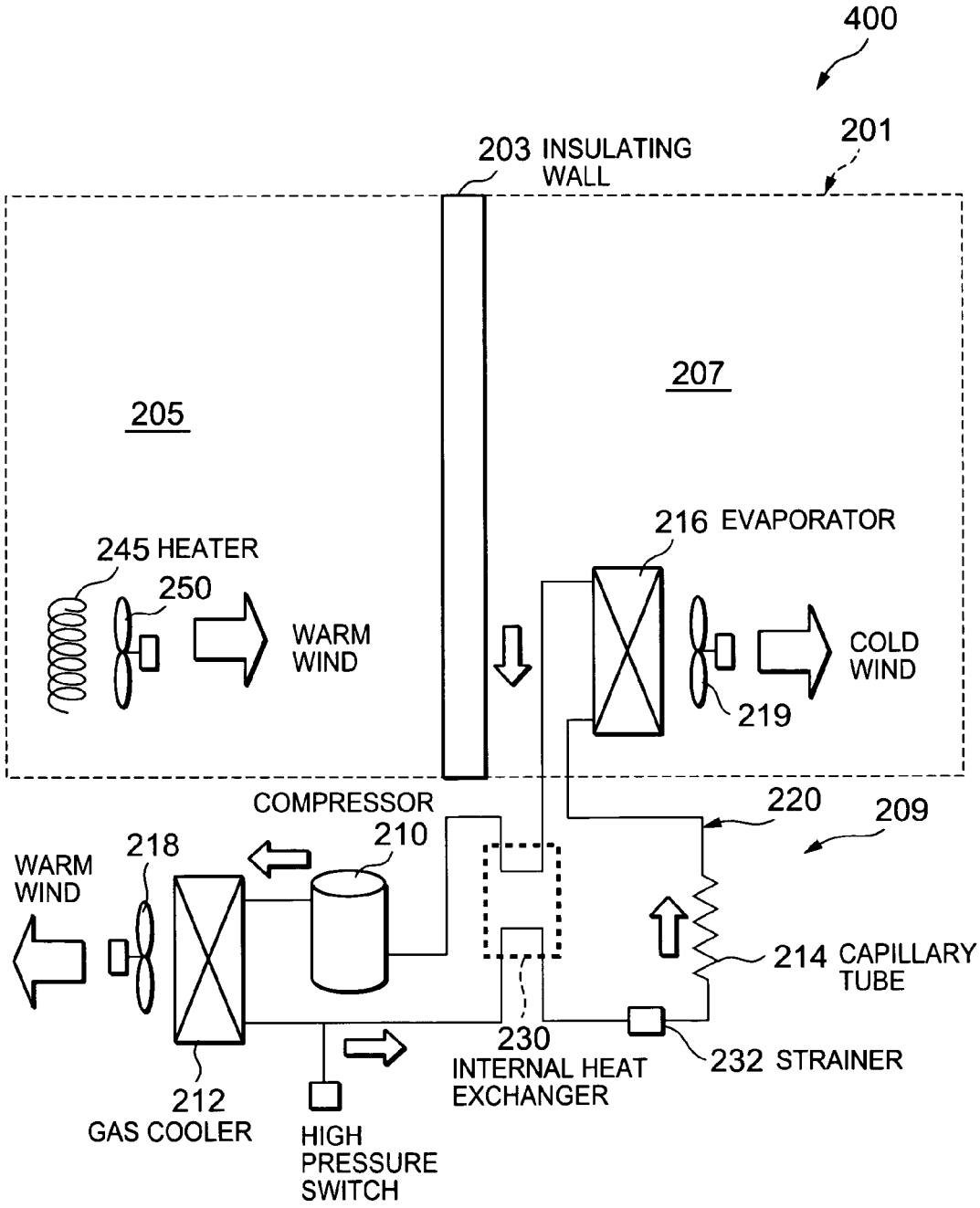
FIG. 5 is an internal constitution diagram of a conventional heating and cooling system.

Next, still another embodiment of a heating and cooling system of the present invention will be described with reference to FIGS. 3 and 4. FIGS. 3 and 4 show internal constitution diagrams of a heating and cooling system 300 in this case. In FIGS. 3 and 4, components denoted with the same reference numerals as those of FIG. 1 or 2 produce the same or similar effects.

In FIGS. 3 and 4, reference numeral 36 is a temperature sensor which is detection means for detecting the temperature of the air which has exchanged heat with a gas cooler 12, and the temperature sensor 36 is connected to a control device 110 described later. Reference numeral 37 denotes a temperature sensor for detecting the air temperature in a first receiving chamber 5, and the temperature sensor 37 is connected to the control device 110. Reference numeral 38 denotes a temperature sensor for detecting the air temperature in a second receiving chamber 7, and the temperature sensor 38 is connected to the control device 110 in the same manner as in the temperature sensors 36 and 37.

On the other hand, a communication hole 50 connected to the outside of the heating and cooling system 300 is formed in the vicinity of one-end opening of a duct 40, and the communication hole 50 is openable/closable by a switching plate 55. The switching plate 55 switches whether to blow the air which has exchanged the heat with the gas cooler 12 into the duct 40 by a fan 18 or to discharge the air to the outside from the communication hole 50, and the switching plate 55 is switched by a motor or a solenoid controlled by the control device 110.

Here, the control device 110 controls the heating and cooling system 300, and an input of the control device 110 is connected to a high pressure switch 34, and the temperature sensors 36, 37, 38. Moreover, a compressor 10 and the fan 18 connected to an output, a fan 19 of the second receiving chamber 7, and a fan 47 of the first receiving chamber 5 are controlled based on these inputs. Furthermore, the control device 110 controls the switching plate 55 at the temperature of the air which has exchanged the heat with the gas cooler 12, detected by the temperature sensor 36, and the air temperature in the first receiving chamber 5, detected by the temperature sensor 37.

That is, the temperature of the air which has exchanged the heat with the gas cooler 12, detected by the temperature sensor 36, is higher than that of the air in the first receiving chamber 5; detected by the temperature sensor 37. In this case, as shown in FIG. 3, the control device 110 opens the duct 40, closes the communication hole 50, and allows the air which has exchanged the heat with the gas cooler 12 to flow in the duct 40 by the fan 18. On the other hand, the temperature of the air which has exchanged the heat with the gas cooler 12, detected by the temperature sensor 36, is lower than that of the air in the first receiving chamber 5, detected by the temperature sensor 37. In this case, in order to prohibit the heating of the inside of the first receiving chamber 5 by the gas cooler 12, as shown in FIG. 4, the control device 110 opens the communication hole 50, closes the duct 40 by the switching plate 55, and prevents the air from the gas cooler 12 from being passed in the duct 40.

Next, an operation of the heating and cooling system 300 constituted as described above in this case will be described. The control device 110 starts operations of the fan 18 disposed in a machine chamber 9, the fan 19 disposed in the second receiving chamber 7, and the fan 47 disposed in the first receiving chamber 5, and also starts a driving element of the compressor 10. The control device 110 also starts power supply to an electric heater 45. Accordingly, the air heated by the electric heater 45 is circulated in the first receiving chamber 5 by the fan 47 as in the above-described embodiment, and heats the first receiving chamber 5, and a material to be heated, received in the first receiving chamber 5.

Moreover, by the starting of the driving element, a low pressure refrigerant gas is drawn in a cylinder of the compression element (not shown) of the compressor 10 from a refrigerant introducing tube 22, compressed to constitute a high temperature/pressure refrigerant gas, and discharged to the outside of the compressor 10 from a refrigerant discharge tube 24. In this case, the refrigerant is compressed to an appropriate supercritical pressure, and the refrigerant gas discharged from the refrigerant discharge tube 24 flows into the gas cooler 12 disposed in the machine chamber 9, and emits heat.

Here, as described above, the temperature of the air which has exchanged the heat with the gas cooler 12, detected by the temperature sensor 36, is higher than that of the air in the first receiving chamber 5, detected by the temperature sensor 37 as described above. In this case, as shown in FIG. 3, the control device 110 opens the duct 40, and closes the communication hole 50.

Accordingly, the air heated at the high temperature by the heat emitted by the high temperature/pressure refrigerant in the gas cooler 12 is blown into the duct 40 by the operation of the fan 18, and the inside of the duct 40 is heated. Since the duct 40 is disposed in such a manner as to exchange the heat with the first receiving chamber 5, the first receiving chamber 5 is heated by radiant heat of the duct 40. Accordingly, the material to be heated, received in the first receiving chamber 5, can also be heated.

Therefore, in the same manner as in the above-described embodiments, the first receiving chamber 5 and the material to be heated, received in the first receiving chamber 5, can be heated by both the radiant heat from the duct 40 and the air heated by the electric heater 45 and circulated by the fan 47. Accordingly, a heating efficiency of the first receiving chamber 5 is enhanced. When the first receiving chamber 5 is heated by the radiant heat from the duct 40 in this manner, the first receiving chamber 5 can be sufficiently heated without increasing the capacity of the electric heater 45, and therefore the power consumption can be reduced.

On the other hand, the temperature of the air which has exchanged the heat with the gas cooler 12, detected by the temperature sensor 36, is lower than that of the air in the first receiving chamber 5, detected by the temperature sensor 37. In this case, in order to prohibit the heating of the inside of the first receiving chamber 5 by the gas cooler 12, as shown in FIG. 4, the control device 110 opens the communication hole 50, and closes the duct 40 by the switching plate 55.

Accordingly, the air which has exchanged the heat with the gas cooler 12 is discharged to the outside of the heating and cooling system 300 from the communication hole 50 by the fan 18 without being blown into the duct 40. Therefore, it is possible to avoid beforehand a disadvantage that the first receiving chamber 5 is cooled by the air which has exchanged the heat with the gas cooler 12 and whose temperature is lower than that in the first receiving chamber 5.

Thus, the temperature of the air which has exchanged the heat with the gas cooler 12, detected by the temperature sensor 37, is higher than that in the first receiving chamber 5, detected by the temperature sensor 37. In this case, as described above, the control device 110 blows the air which has exchanged the heat with the gas cooler 12 into the duct 40, and the first receiving chamber 5 can be heated by the electric heater 45 disposed in the first receiving chamber 5, and the radiant heat from the duct 40. Accordingly, a heating efficiency of the first receiving chamber 5 can be enhanced.

Furthermore, the temperature of the air which has exchanged the heat with the gas cooler 12, detected by the temperature sensor 37, is lower than that in the first receiving chamber 5, detected by the temperature sensor 37. In this case, the control device 110 does not blow the air which has exchanged the heat with the gas cooler 12 into the duct 40, and it is possible to avoid beforehand a disadvantage that the first receiving chamber 5 is cooled.

Generally, the heating efficiency of the first receiving chamber 5 in the heating and cooling system 300 is improved, while the power consumption can be reduced.

On the other hand, the refrigerant discharged from the gas cooler 12 next passes through an internal heat exchanger 30. Then, the heat of the refrigerant is taken by a refrigerant on the low pressure side, which has been discharged from the evaporator 16, and the refrigerant is further cooled and reaches the capillary tube 14 via a strainer 32. Moreover, the refrigerant is formed into a two-phase mixed refrigerant of a gas/liquid by a pressure drop in the capillary tube 14, and flows into the evaporator 16 disposed in the second receiving chamber 7 in this state. Then, the refrigerant evaporates, and absorbs the heat from ambient air to thereby fulfill a cooling function. It is to be noted that the air cooled by the evaporation of the refrigerant in the evaporator 16 is circulated in the second receiving chamber 7 by the operation of the fan 19, and cools the second receiving chamber 7 and a material to be cooled, received in the second receiving chamber 7.

Moreover, the refrigerant flows out of the evaporator 16, enters the refrigerant introducing tube 22, and passes through the internal heat exchanger 30 as described above. In this process, the refrigerant takes the heat from the refrigerant on the high pressure side, is subjected to a heating function, and is drawn in the compression element of the compressor 10 from the refrigerant introducing tube 22. This cycle is repeated.

What is claimed is:

1. A heating and cooling system which is equipped with a first receiving chamber for receiving a material to be heated and a second receiving chamber for receiving a material to be cooled, the system comprising:

a refrigerant circuit in which a compressor, a gas cooler, pressure reducing means, and an evaporator are circularly connected by pipes and in which carbon dioxide is as a refrigerant;

a duct disposed in such a manner as to exchange heat, by means of radiation, with the inside of the first receiving chamber;

first blowing means for blowing air which has exchanged the heat with the gas cooler into the duct, the duct being in communication with the gas cooler; and second blowing means for blowing air which has exchanged the heat with the evaporator into the second receiving chamber, the evaporator being in communication with the second receiving chamber, wherein the compressor, the gas cooler, the pressure reducing means and the pipes are disposed outside of the first receiving chamber.

* * * * *